United States Patent [19]

Putetti

[11] 4,283,932

[45] Aug. 18, 1981

[54] TOGGLE-ACTUATED PUNCH STRIPPER

[75] Inventor: Anthony M. Putetti, Waterbury, Conn.

[73] Assignee: Textron, Inc., Cheshire, Conn.

[21] Appl. No.: 44,015

[22] Filed: May 31, 1979

[51] Int. Cl.[3] ..... B21D 45/00

[52] U.S. Cl. ..... 72/345; 72/427

[58] Field of Search ..... 72/344, 345, 427

[56] References Cited

U.S. PATENT DOCUMENTS

| | | | |
|---|---|---|---|
| 2,884,822 | 5/1959 | Wilson | 72/345 |
| 3,570,300 | 3/1971 | Schulte | 72/427 |
| 3,911,719 | 10/1975 | Degenhardt | 72/345 |

*Primary Examiner*—Leon Gilden

*Attorney, Agent, or Firm*—DeLio and Montgomery

[57] ABSTRACT

In a forming press, toggle-type punch stripper actuation mechanism for mechanically driving the punch shoe in a direction to strip the workpiece from the punch as a function of the relative movements of the punch and stripper sleeve.

8 Claims, 8 Drawing Figures

TOGGLE-ACTUATED PUNCH STRIPPER

This invention relates to a toggle-actuated shoe for removing a formed workpiece from the punch, as in a press, and holding it accurately on the die center, to be gripped by transfer fingers for movement to the next die station.

A workpiece which is given a concave shape corresponding to the shape of the punch which has acted on it commonly tends to remain on the punch when the latter is withdrawn from the die with which it cooperates. Heretofore, workpieces have been pushed off the end of the receding punch, and thus left in the die, by the action of a heavy spring on the lower shoe portion of the punch. Such a spring has to be strong enough to overcome the frictional force holding the workpiece on the punch and to force the shoe away from the end of the punch as the punch recedes. Failure of the spring to function as required necessitates immediate stopping of the press to release the workpiece, while increasing the size and strength of springs makes them too bulky for the limited space available and subject to fatigue and failure.

It is accordingly an object of the present invention to provide mechanical linkages which effect, in a positive manner, the displacement of the workpiece from the punch.

It is a further object of the invention to provide a toggle connection between the punch and the punch shoe with means on the stripper sleeve for actuating the toggle.

It is another object of the invention to provide means to displace the workpiece from the punch in a position where it can be reliably picked up by the transfer fingers.

It is a still further object of the invention to provide certain improvements in the form, construction and arrangement of the several parts whereby the above-named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawings wherein.

Figure 1:
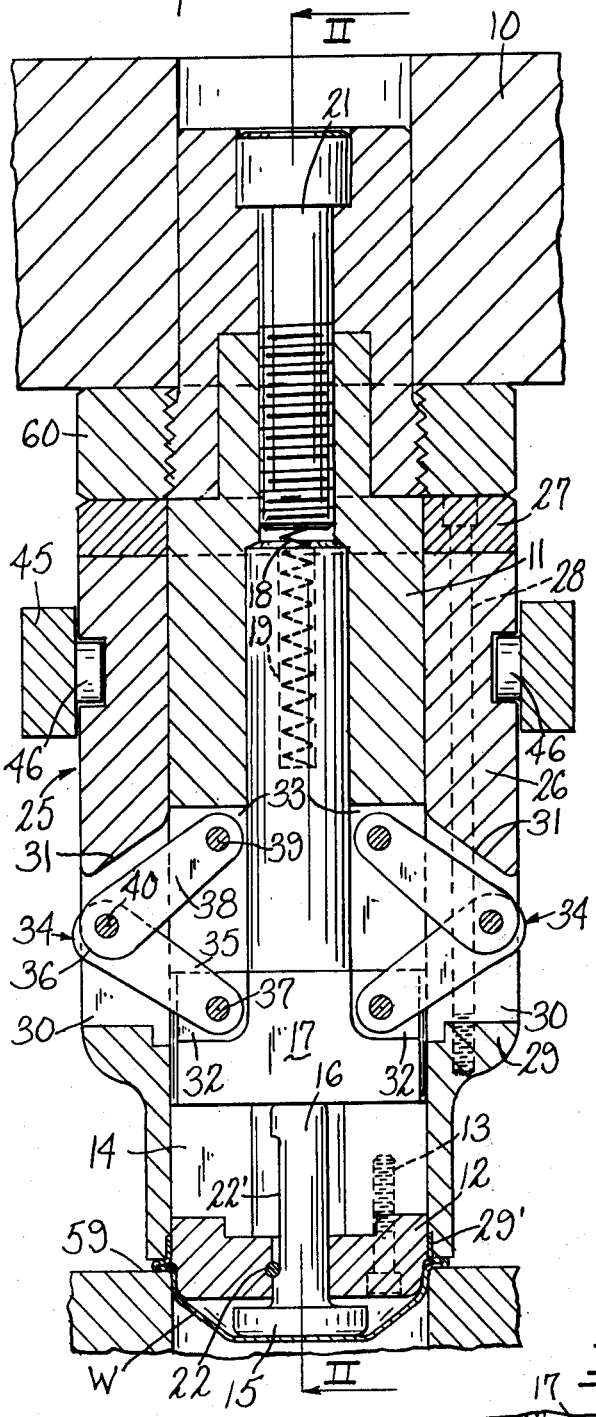
FIG. 1 represents a vertical section through the punch and associated parts in their lowest positions.
Figure 6:
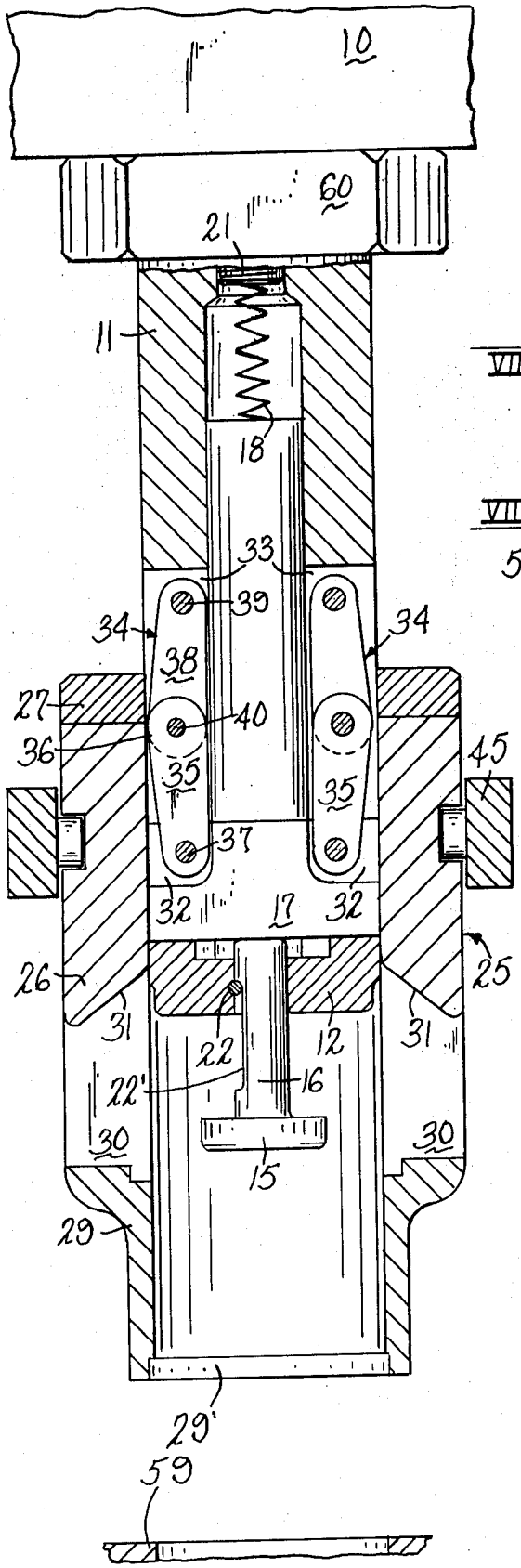
FIG. 6 represents a vertical section of the same parts at the top of the stroke.

Referring to the drawings, the ram portion 10 of the die set carries a punch assembly which comprises the punch body 11 having a base 12 mounted thereon by means of screws 13 (one being shown), the lower portion of the body being provided with a diametrically extending chamber 14. A shoe 15 has its stem 16 journaled in the base and resting against the bottom of the arm 17, and a spring 18 biases the arm downward. The spring is seated in a cavity 19 in the upper portion of the arm and projects upward, under compression, having its upper end bearing on the end of the cap screw 21 which holds the punch body firmly in place. A key 22 in the base 12 fits in a flattened race 22' on one side of the stem 16 and serves to limit the vertical movement of the shoe, in either direction, relative to the punch body, as illustrated in FIGS. 1 and 6.

The stripper sleeve 25 is a generally cylindrical element within the bore of which the punch body and base are freely slidable. The sleeve comprises a body 26 topped by an annulus 27, held in place by long cap screws 28 (one being shown), which extend into the base 29. In the assembly here illustrated, the lower edge of the sleeve is internally rabetted, at 29', to accommodate the edge of the cup-shaped workpiece W in which a crimped outside finish is being formed. The sleeve is provided with oppositely disposed radial openings 30 in the form of vertical slots, the upper wall of each being beveled to form a shoulder or ramp 31, serving a purpose described below.

The portions of the arm 17 which extend into the chamber 14 are provided with flat upwardly-extending webs 32 above which the punch body is vertically slotted, at 33, and toggle linkages 34 connect the arm to the body. Each linkage comprises a lower link 35 havihg a clevis 36 pivoted by means of a pin 37 on a respective web 32, and an upper link 38 pivoted by means of a pin 39 in the upper portion of a respective slot 33. The links are pivotally connected to each other by the pins 40, and the arrangement is such that the toggle linkages project freely into the openings 30 of the sleeve, as shown in FIG. 1, when the punch body and the shoe are in their lowest position relative to the sleeve, the toggle being folded.

Figure 7:
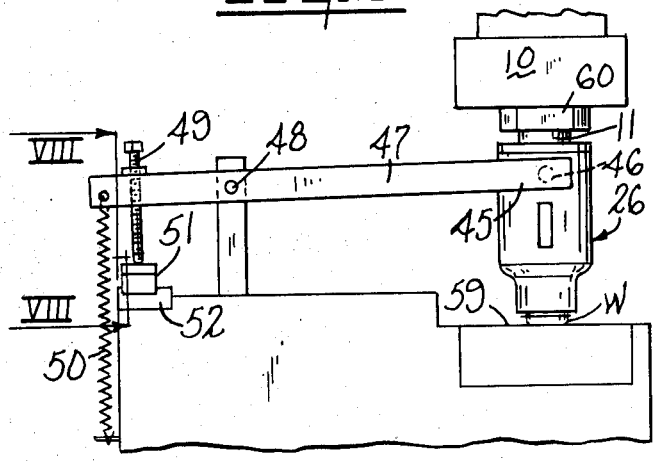
FIG. 7 is a somewhat diagrammatic elevation of the sleeve-actuating mechanism.
Figure 8:
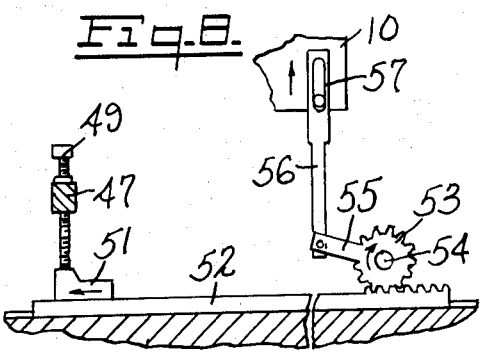
FIG. 8 is a detail elevational view, in the direction of the arrows VIII—VIII in FIG. 7, showing the sleeve-drive control.

In order to obtain the desired synchronization of the several moving elements, the position of the sleeve is independently determined by the provision of a yoke 45 (FIG. 7) engaging the sleeve by trunnions 46, the yoke being one end of a lever 47 pivotally mounted at 48 on the frame of the press, the other end of the lever being provided with the adjusting screw 49 and being biased downwardly by the spring 50. The height to which the yoke can raise the sleeve is determined by the position of a two-level face cam 51 (FIG. 8) on one end of a rack bar 52 which can be moved by the pinion 53 (on a fixed pivot 54), the pinion being rotated by means of its lever 55 connected to the link 56 which has a lost-motion connection at 57 to the ram 10.

Figure 2:
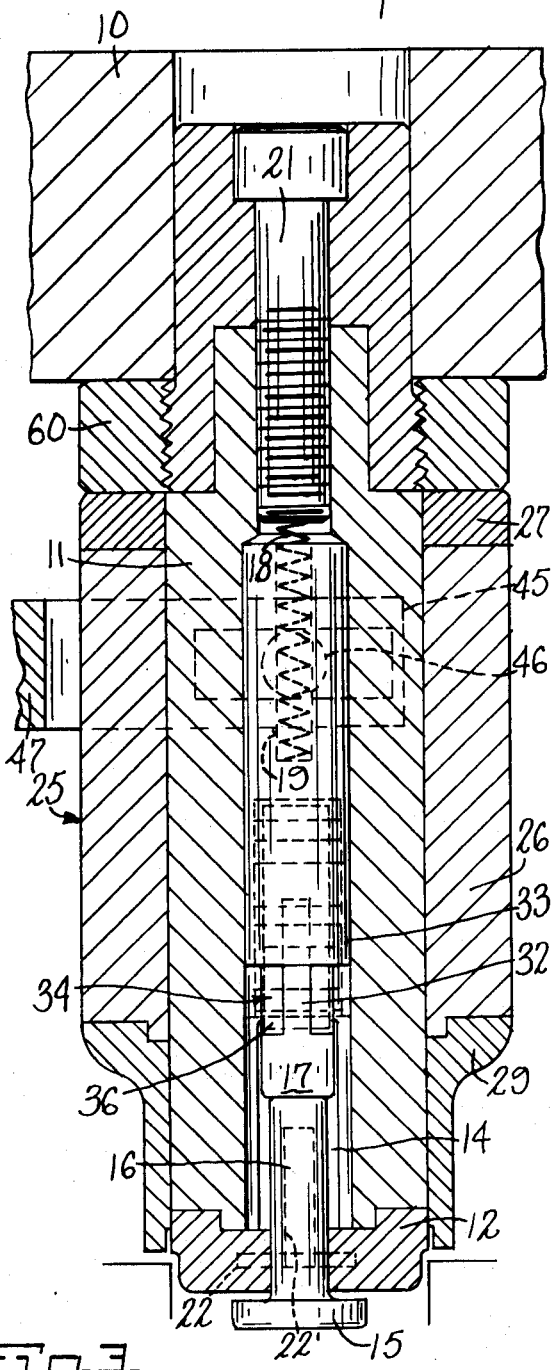
FIG. 2 represents a vertical section on the line II—II of FIG. 1, the workpiece being omitted.
Figure 3:
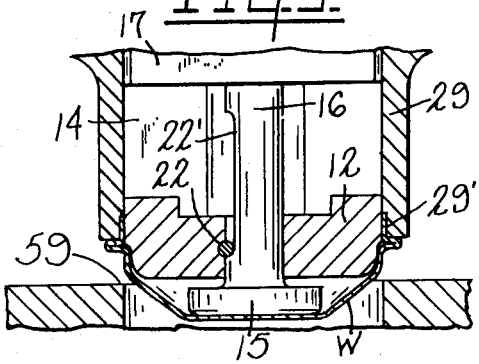
FIG. 3 represents a detail vertical section as in FIG. 1 showing the lower end of the punch with the workpiece lifted off the die.

When the punch and its supporting mechanism is in its lowest position (FIGS. 1 and 2) with the workpiece W resting in the die 59, the top of the sleeve bears firmly against the nut 60, on the punch support, and the screw 49 is lifted slightly off the high part of the cam 51. The first upward movement of the punch, to the position of FIG. 3, permits the screw 49 to come to rest on the cam, as in FIGS. 7 and 8, and the upward movement of the sleeve is arrested at that level while the punch rises to the position of FIG. 4, the top of the sleeve being spaced from the nut 60 by a small distance. At this point, the upper toggle links 38 have come into contact with the beveled shoulders or ramps 31, causing the toggles to start straightening out and pushing downward the arm 17 and shoe 15. Further upward movement of the punch is shown in FIG. 5, the workpiece here being fully separated from the punch and in a position to be grasped by transfer fingers, not shown, for removal to another station or out of the machine when the shoe is withdrawn. At this elevation, the end of the lost motion 57 has been reached so that the continued upward movement of the punch and ram rotates the pinion 53 in the direction of the arrow in FIG. 8, moving the cam to permit the screw to move to the lower part of the cam, so that the spring 50 can cause the yoke to raise the sleeve to the positions of FIGS. 5 and 6, successively.

In FIG. 6, the punch is shown fully retracted, while the sleeve is raised sufficiently to permit the placement of another workpiece. The toggle is straightened out but the location of the pivot points is such that it is not locked, the pins 40 never quite reaching alignment with the pins 37 and 29. When the punch is lowered through the sleeve to the levels represented by FIGS. 5 and 4, the toggles fold outwardly under the influence of the spring 18, under tension.

The sleeve is constantly biased upward by the spring 50, its upward movement being limited, however, by contact of its top 27 with the nut 60 (FIG. 1) or by contact of the adjusting screw 49 with the higher or lower parts of the face cam 51. The shoe 15 is constantly biased downward both by gravity and by the spring 18 so that it rests in its lowest position relative to the base of the punch (FIG. 6) except when it is brought to bear on a workpiece, as in FIGS. 1, 3, 4 and 5.

Figure 4:
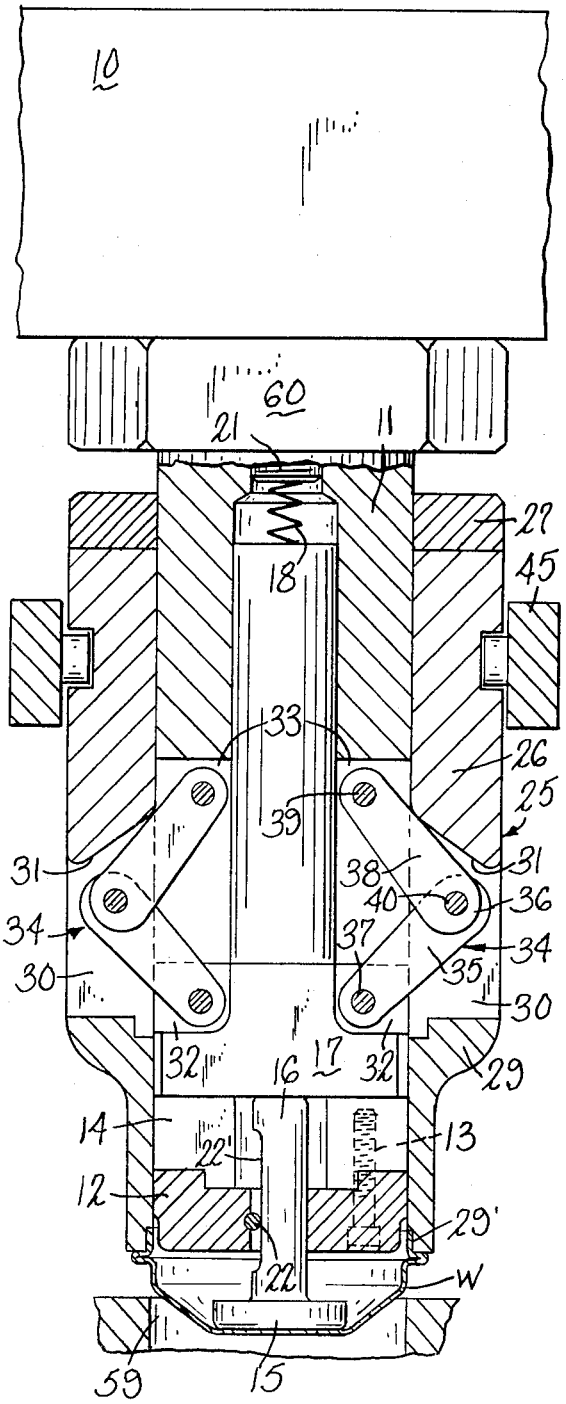
FIG. 4 represents a detail section through the parts shown in FIGS. 1, 2 and 3, lifted to the point where the toggle starts to act.
Figure 5:
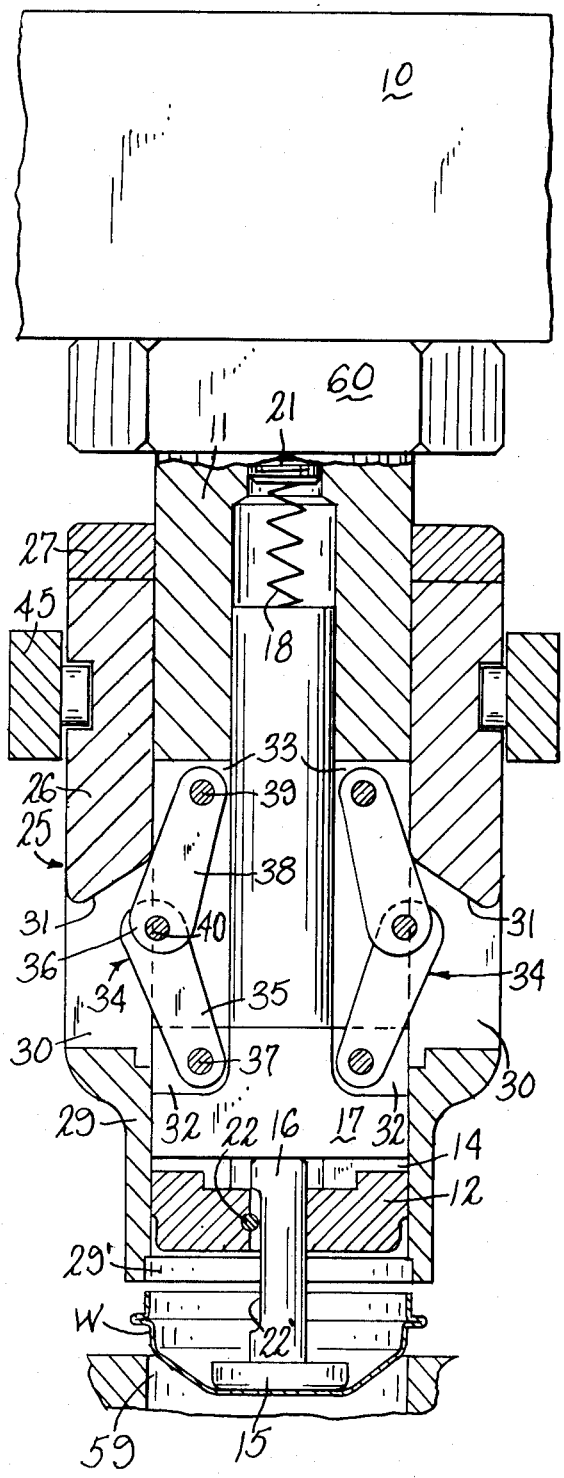
FIG. 5 represents a vertical section of the same parts with the punch further elevated, the toggle cammed to lower the shoe and the workpiece stripped from the sleeve.

The separation of the workpiece from the punch is effected in a positive manner by withdrawal of the punch base while the workpiece is held by the shoe and sleeve, as shown in FIG. 4, followed by withdrawal of the sleeve while the workpiece is held down by the shoe, as shown in FIG. 5. The elongation of the toggles takes place at a rate which causes the shoe to remain substantially stationary in space, i.e., at the top of the die opening, as the punch and sleeve are withdrawn.

The ram 10 and parts carried thereby are reciprocated toward and away from the die 59 (in a die bed, not shown) by conventional means, the limits of travel being illustrated in FIGS. 1 and 6. The specific sizes and shapes of the punch assembly and the die may be varied according to the work to be done, but the presence of a punch, shoe and stripper sleeve or their equivalents is assumed.

While the toggle-type shoe actuation means is shown in connection with a vertically moving punch, such mechanism could readily be adapted to the stripper on a horizontally moving ram and punch, with suitable modification of the sleeve drive. The toggle connection between the punch and shoe actuated by the stripper sleeve movement, makes possible the positive mechanical release of the workpiece whatever may be the orientation of the forming elements in the press.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

What I claimed is:

1. A workpiece releasing mechanism in a forming press having a frame, a punch, a die and means for reciprocating the punch toward and away from the die, said mechanism comprising a punch shoe movable axially relative to the end of the punch, a stripper sleeve slidable longitudinally on the punch, a toggle linkage between the punch and the shoe, means on the sleeve for actuating the toggle linkage in the elongation mode, and means for moving the sleeve axially of the punch as a function of the changing position of the punch relative to the die.

2. A mechanism according to claim 1 which includes biasing means urging the shoe toward an extended position.

3. A mechanism according to claim 2 wherein the punch has an axially extending slot and the biasing means includes an arm slidable axially in said slot and a spring urging said arm toward the end of the punch, the shoe having a stem portion adapted to bear against said arm.

4. A mechanism according to claim 3, wherein the toggle linkage has one end pivotally connected to the punch and one end pivotally connected to the arm.

5. A mechanism according to claim 1 wherein the sleeve is provided with an opening in its wall and the toggle linkage in its folded mode rests at least partly within said opening.

6. A mechansim according to claim 5 wherein the toggle linkage actuating means is constituted by a ramp associated with the opening in the sleeve.

7. A mechanism according to claim 1 wherein the means for determining the position of the sleeve includes an element associated with the punch and adapted to drive the sleeve to its position nearest the die, an element mounted on the machine frame and adapted to bias the sleeve away from the die, and means associated with the last-named element for controlling the distance the sleeve can be moved.

8. A mechanism according to claim 7 which includes means for adjusting said controlling means as a function of the movement of the punch.

* * * * *